US008086121B2

(12) United States Patent
Kobayashi

(10) Patent No.: US 8,086,121 B2
(45) Date of Patent: Dec. 27, 2011

(54) FIXING DEVICE AND IMAGE FORMING DEVICE

(75) Inventor: Kei Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 365 days.

(21) Appl. No.: 12/474,614

(22) Filed: May 29, 2009

(65) Prior Publication Data

US 2009/0324266 A1 Dec. 31, 2009

(30) Foreign Application Priority Data

Jun. 30, 2008 (JP) ..... 2008-169834

(51) Int. Cl.
*G03G 15/00* (2006.01)

(52) U.S. Cl. ..... 399/45; 399/67; 399/69

(58) Field of Classification Search ..... 399/38, 399/45, 67–70, 320, 328, 329; 219/216, 219/619

See application file for complete search history.

(56) References Cited

U.S. PATENT DOCUMENTS 7,664,416 B2 * 2/2010 Watabe ..... 399/69
7,920,802 B2 * 4/2011 Minagawa ..... 399/69

FOREIGN PATENT DOCUMENTS

JP A-H04-217286 8/1992
JP A-2001-201978 7/2001
JP A-2006-227487 8/2006
JP 2007-322888 A 12/2007

* cited by examiner

*Primary Examiner* — Hoan Tran
(74) *Attorney, Agent, or Firm* — Posz Law Group, PLC

(57) ABSTRACT

A fixing device comprise an endless fixing belt; a first heater that heats a first predetermined section of the fixing belt, a second heater that heats a second predetermined section of the fixing belt, a switch that determines whether or not the second predetermined section of the fixing belt is heated by the second heater, a controller controls a switching operation of the switch according to a size of a medium on which an image is fixed by the fixing belt, and a temperature controller that reduces a heating temperature of the first heater when the second predetermined section of the fixing belt is heated by the second heater.

20 Claims, 13 Drawing Sheets

FIXING DEVICE AND IMAGE FORMING DEVICE

The present application is related to, claims priority from and incorporates by reference Japanese Patent Application No. 2008-169834, filed on Jun. 30, 2008.

TECHNICAL FIELD

The present invention relates to a fixing device that fixes a toner image to a medium in an image forming device that uses an electrophotographic, for example, a printer, a copying machine, and a facsimile machine.

BACKGROUND

A fixing device for fixing a toner image is used in an electrophotographic image forming device, for example, a printer, a copying machine, and a facsimile machine, as a fixing device. A known fixing device using an endless belt (a fixing belt) is effective in power-saving or improving a rise time speed in contrast with the conventional heat roller method. For example, Japanese laid-open patent application No. 2007-322888 discloses a fixing device using such a fixing belt.

In a fixing device using a fixing belt, a fixing roller is arranged in a position that is counter to a pressure roller and inside a loop of the fixing belt, and a nipping part is formed at the position where the fixing roller is pressed by the pressure roller. The fixing belt is placed in tension by the fixing roller and a support. When the pressure roller is rotated by a driving source, the fixing belt and the fixing roller are driven to rotate by the frictional force between the pressure roller and the fixing belt, and the frictional force between the fixing belt and the fixing roller. A medium is fed and pressed through the nipping part, and the unfixed toner on the medium is fixed as an image by heat and pressure, in the condition that a temperature of the fixing belt is heat-controlled by a heat source to a predetermined value.

However, in the conventional fixing device using the fixing belt mentioned above, heat is transferred to the medium from a part (a medium-contacting part) in contact with the medium on the fixing belt, and the temperature of the part is lowered accordingly. On the other hand, a part of the fixing belt (a non-medium-contacting part) that does not contact the medium maintains a relatively high temperature since heat is not transferred to the medium from such part. The heat conductivity of a fixing belt is low and a significant amount of heat is not transferred from the non-medium-contacting part to the medium-contacting part in the belt itself. Therefore, a difference in temperature occurs between the medium-contacting part and the non-medium-contacting part on the fixing belt.

As a result, when an image is fixed to a narrow-width medium (NWM), which is much narrower than the fixing belt, the non-medium-contacting part becomes relatively warmer since it is heated without losing heat to the medium. When an image is fixed to a wide-width medium (WWM) just after that, the fixing temperature differs between the medium-contacting part and the non-medium-contacting part, which results in unevenness in the fixing of the toner.

The present invention is made in view of the problem mentioned above, and it is the object to provide a fixing device that makes the difference in temperature between a medium-contacting part and a non-medium-contacting part as small as possible, even when an image is fixed to an NWM followed by a WWM, which improves the uniformity of the image fixing of the WWM that follows the NWM.

SUMMARY

In order to solve the above objects, a fixing device related to the invention comprise an endless fixing belt; a first heater that heats a first predetermined section of the fixing belt, a second heater that heats a second predetermined section of the fixing belt, a switch that determines whether or not the second predetermined section of the fixing belt is heated by the second heater, a controller controls a switching operation of the switch according to a size of a medium on which an image is fixed by the fixing belt, and a temperature controller that reduces a heating temperature of the first heater when the second predetermined section of the fixing belt is heated by the second heater.

The present invention reduces the difference in temperature between a medium-contacting part and a non-medium-contacting part of a medium at the time of the NWM fixing on the fixing belt. Therefore, at the time of WWM fixing, that the fixation is more uniform.

DETAILED DESCRIPTION

First Embodiment

Figure 1:
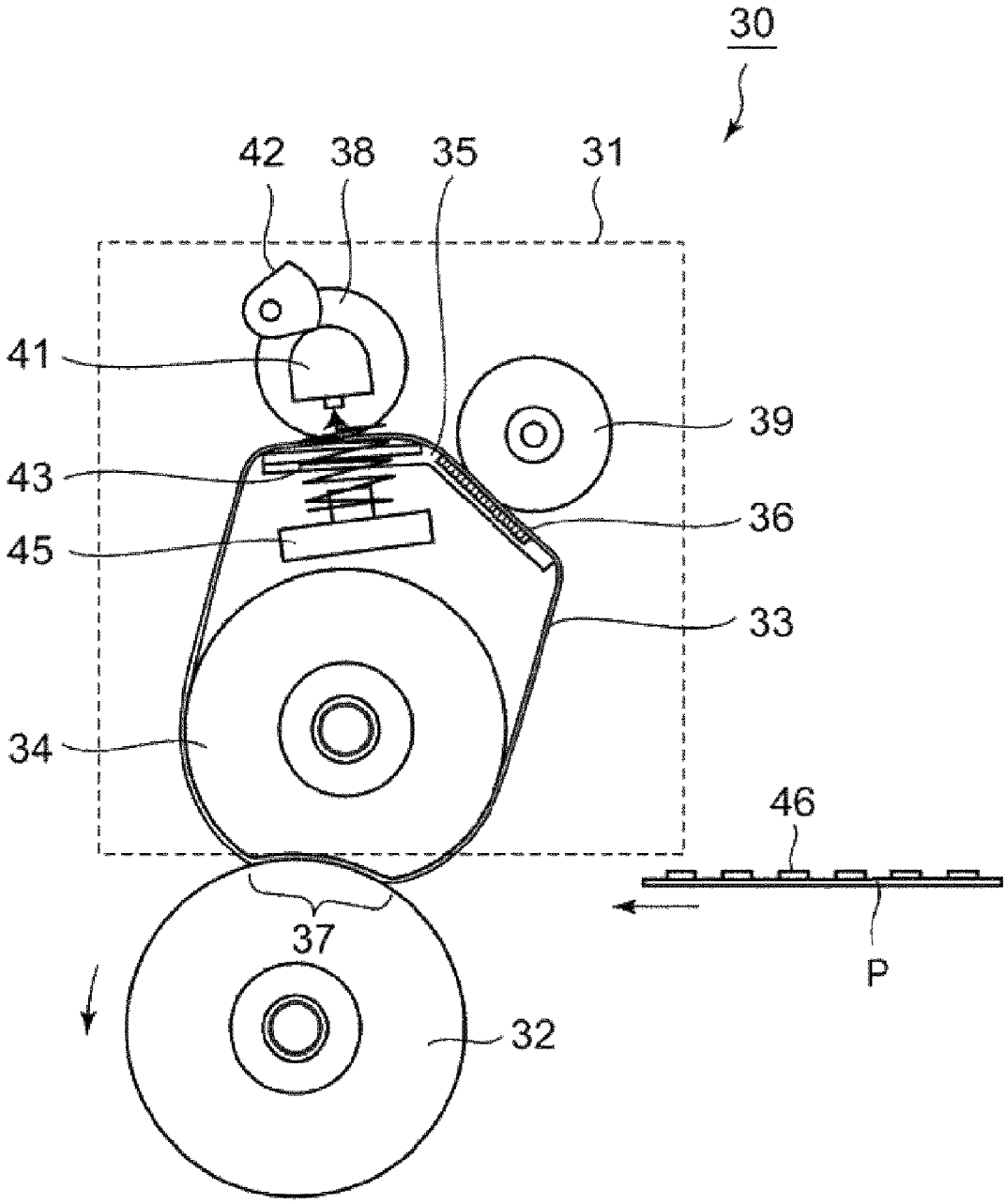
FIG. 1 is a side view of a fixing device of a first embodiment.
Figure 2:
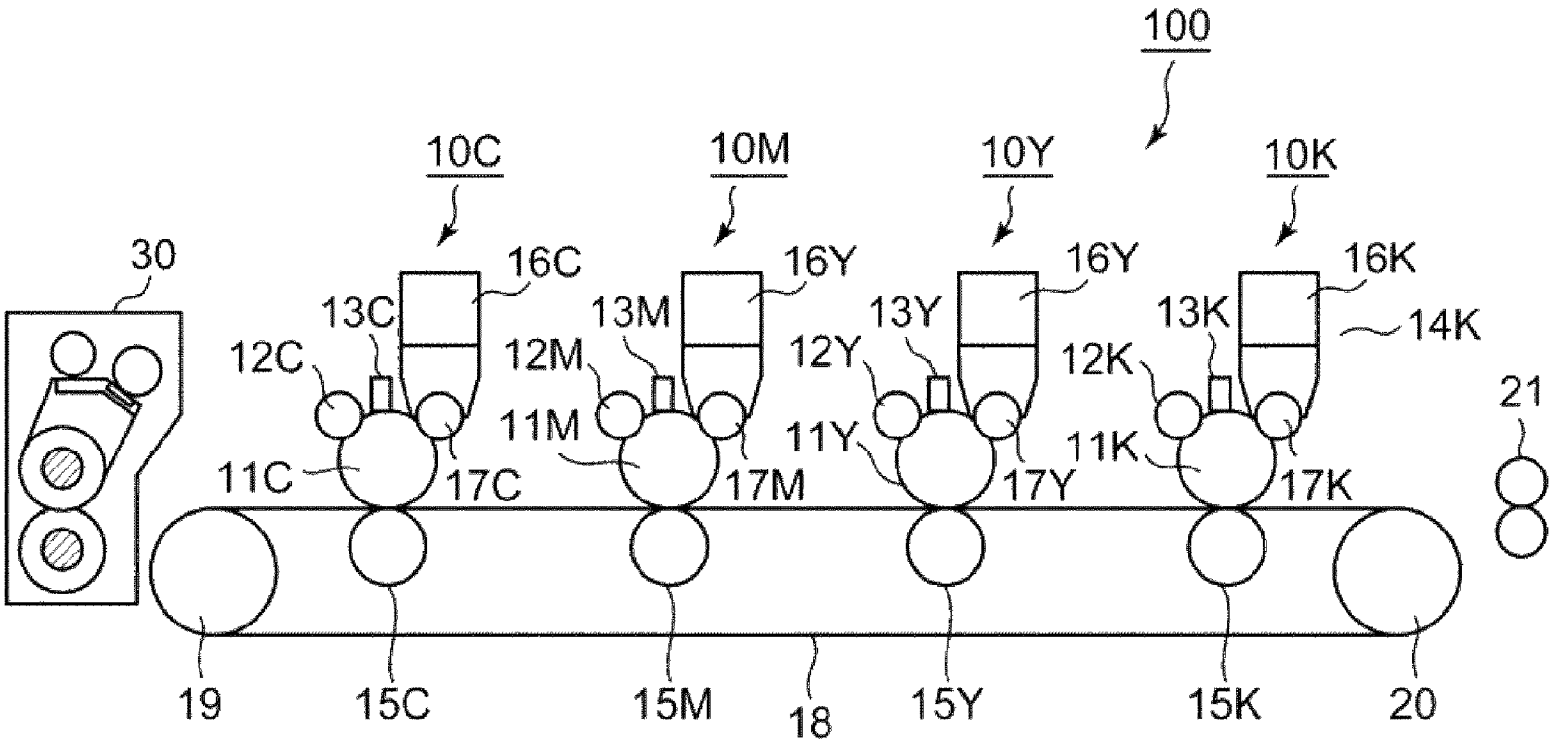
FIG. 2 is a schematic-view of an electrophotographic printer including a fixing device of the first embodiment.

Identical reference characters are used to designate common elements among different embodiments. In addition, in each embodiment described below, an electrophotographic printer is described as an example of an image forming device. FIG. 1 illustrates a side view of a fixing device 30 of a first embodiment. FIG. 2 illustrates a schematic configuration view of an electrophotographic printer 100 including the fixing device 30 of the first embodiment. Initially, the electrophotographic printer 100 is described according to FIG. 2.

In FIG. 2, the electrophotographic printer 100 includes image forming units 10K, 10Y, 10M, and 10C of black, yellow, magenta, and cyan, respectively. Only the image forming unit 10K of black is described, since the configuration of each image forming unit 10K, 10Y, 10M, and 10C is similar. In the image forming unit 10K, a photoconductive drum 11K as an image supporter, an electrostatic roller 12K, which evenly charges the surface of the photoconductive drum 11K, an exposing head 13K, which forms a latent image on the charged photoconductive drum 11K based on print data, a developing device 14K, which develops the image by adhering toner to the latent image on the photoconductive drum 11K, and a transferring roller 15K, which transfers the toner image on the photoconductive drum 11K to a medium P, are arranged. A developing device 14K includes a toner cartridge 16K, which accommodates toner, and a developing roller 17K, which supplies the toner to the photoconductive drum 11K.

An endless carrying belt 18 is rotatably arranged between each of photoconductive drums 11K, 11Y, 11M, and 11C and each of transferring rollers 15K, 15Y, 15M, and 15C; and the carrying belt 18 is provided in a tensioned state between a driving pulley 19 and a driven pulley 20. A carrying roller pair 21 is upstream of the black image forming unit 10K in the medium feeding direction, and the carrying roller pair 21 feeds a medium P fed from a medium cassette (not shown) to the image forming unit 10K. Also, a fixing device 30 is downstream of the cyan image forming unit 10C of in the medium feeding direction.

In FIG. 1, the fixing device 30 includes a fixing belt assembly 31 and a pressure roller 32. The fixing belt assembly 31 includes an endless fixing belt 33, a fixing roller 34, which is inside a loop of the fixing belt 33, a heat transfer member 35, which is similarly arranged inside a loop of the fixing belt 33, and a heat source 36, which is arranged on the heat transfer member 35 towards the fixing belt 33.

The pressure roller 32 and the fixing roller 34 are rollers with an outside diameter of about 20-40 mm, and it includes a heat resistant elastic layer made of silicone rubber with a thickness of 1-10 mm formed on an outer peripheral surface of an iron core, and further a 10-50 μm-thick fluororesin (PFA, PTFE, and FEP; see below) as a release layer formed on the outer peripheral surface. The core can also be made of other metal, for example, aluminium. Also, the heat resistant elastic layer can be made of other elastic materials, for example, silicon sponge and fluororubber. A thermistor as a temperature detector element (not shown) is arranged near a lateral center of the surface of the fixing belt 33.

Figure 3:
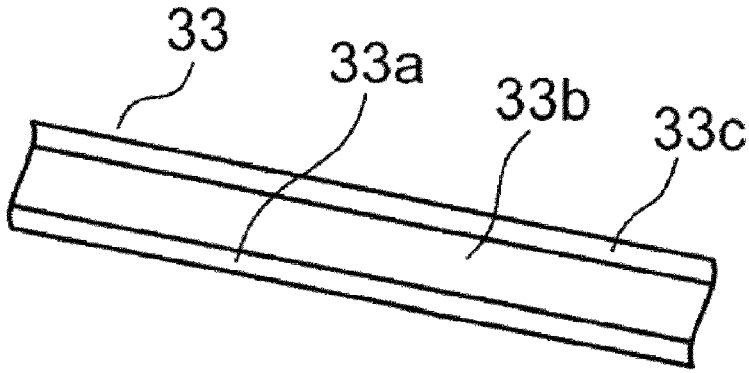
FIG. 3 is a sectional view of a structure of a fixing belt.

FIG. 3 illustrates a sectional view showing the structure of the fixing belt 33. As illustrated in FIG. 3, the fixing belt 33 includes an elastic layer 33*b* made of silicone rubber or fluororesin that is formed on an endless base material 33*a* made of nickel, polyimide, and stainless steel, for example, and a release layer 33*c* made of perfluoro alkoxy alkane (PFA), polytetrafluoroethylene (PTFE), perfluoroethylene propene copolymer (FEP), or the like, which are excellent in mold-resistance and a heat-resistance, further formed on the elastic layer 33*b*. In FIG. 3, the lowermost surface of the belt 33 is the inside of the endless fixing belt 33. In terms of strength and a heat-resistance, it is preferable for the base material 33*a* to have a thickness of 30-150 μm, for the elastic layer 33*b* to have a thickness of 50-300 μm, and for the release layer 33*c* to have a thickness of 10-50 μm.

Figure 4:
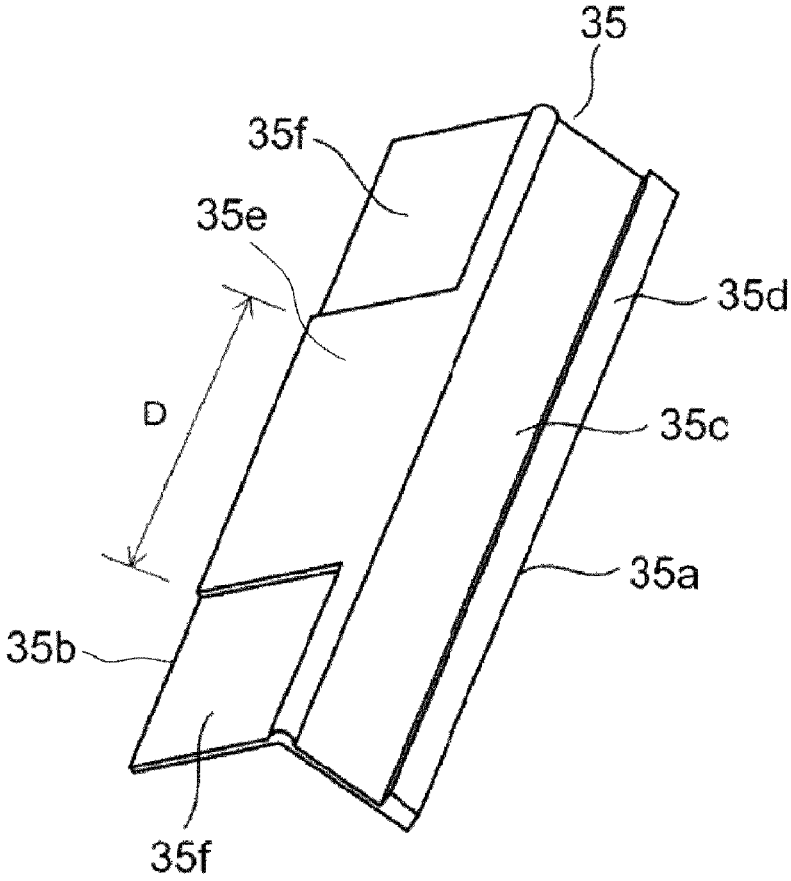
FIG. 4 is a perspective view of a heat transfer member.

FIG. 4 illustrates a perspective view of the heat transfer member 35. As illustrated in FIG. 4, the heat transfer member 35 has a first side 35*a* and a second side 35*b*, and is formed with a dogleg-shape when viewed endwise. A heat source holding unit 35*c* holding the heat source 36 (see FIG. 1) is formed on the first side 35*a*, and an edge 35*d* of the first side 35*a* is configured to be parting contact with the fixing belt 33. The heat source holding unit 35*c* is formed in a concave shape so that the heat source 36, which has a sheet shape, may be arranged in and held by the holding unit 35*c*.

A central convex part 35*e* is formed in a center of the width direction on the second side 35*b* of the heat transfer member 35, and concave parts 35*f* are formed on both sides of the central convex part 35*e*. The central convex part 35*e* can contact the fixing belt 33 according to a switching mechanism that is described later. The width of the central convex part 35*e* of the center of the width direction is set corresponding to the width of a B5 size sheet, as media P, and of a narrow-width medium (NWM) P, such as a postcard. This width is an NWM contacting part D of the fixing belt 33. Also, the concave part 35*f* does not contact the fixing belt 33. The heat transfer member 35 functions as a heater. Specifically, the heat source 36 functions as a first heater, the convex part 35*e* on the second side 35*b* functions as a second heater.

The heat transfer member 35 has a cross-sectional area of about 30-150 $mm^2$, is made of a material with high heat conductivity, such as aluminum, and supports the fixing belt 33 in a tensioned state. The surface of the heat transfer member 35 can be formed by a coating with PFA, PTFE, FEP, and the like, which have an excellent low friction characteristic and heat-resistance, in order to improve the sliding cooperation with the fixing belt 33.

Figure 5:
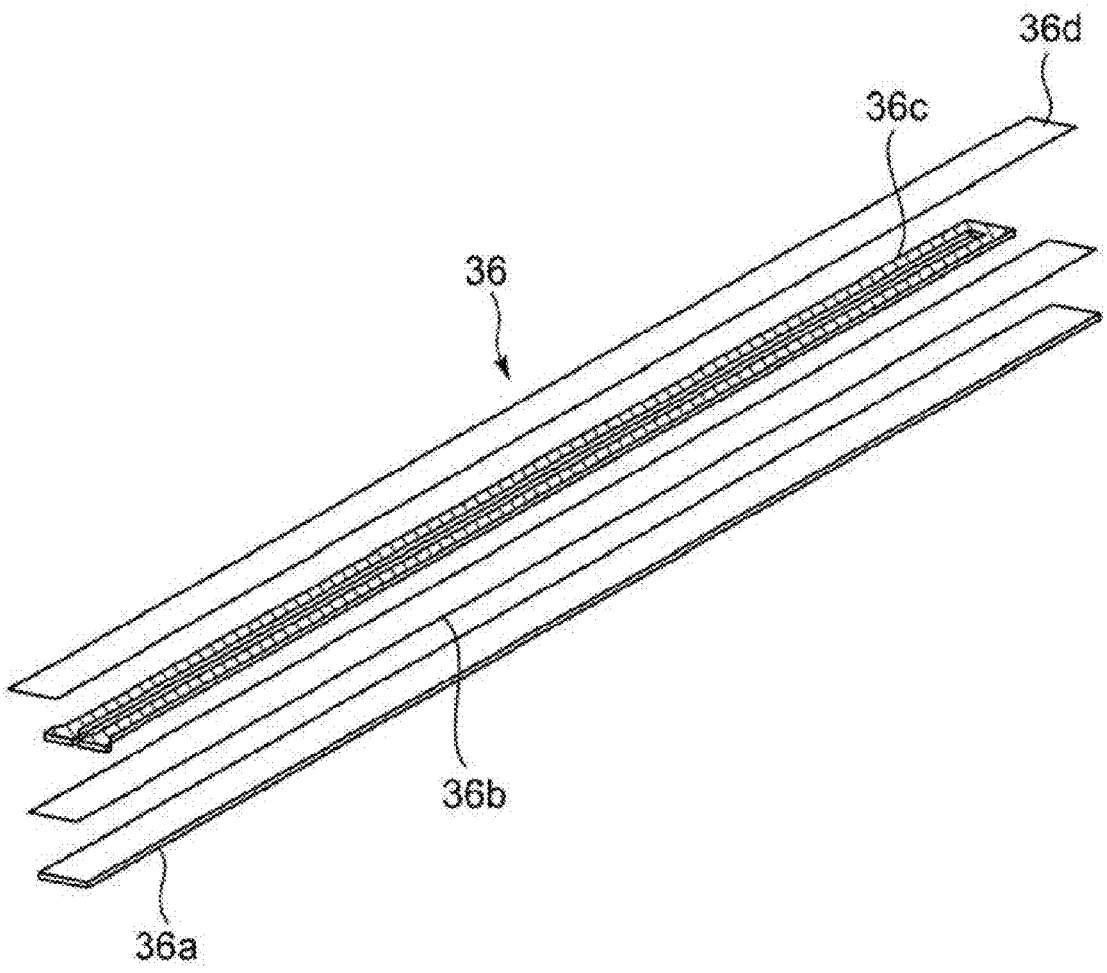
FIG. 5 is an exploded perspective view of a heat source.

FIG. 5 illustrates an exploded perspective view of a heat source 36. As illustrated in FIG. 5, the heat source 36 includes an electrical insulation layer 36*b*, such as glass, on a substrate 36*a*, which is made of stainless steel or ceramics, coated by a resistance heating element 36*c*, which includes powder of a nickel-chromium alloy or a silver-palladium alloy, or the like, on it and further includes a protective layer 36*d* that includes glass, and fluororesin (PFA, PTFE, FEP), or the like. The heat source 36 contacts the fixing belt 33 by being arranged in the heat source holding unit 35*c* of the heat transfer member 35.

Referring to FIG. 1, when a pressure roller 32 contacts a fixing roller 34 with a predetermined pressure through the fixing belt 33, a nipping part 37 is formed between the rollers. When a medium P, which carries an unfixed toner image 46, passes through the nipping part 37, the unfixed toner image 46 is fixed to the medium P.

Figure 6:
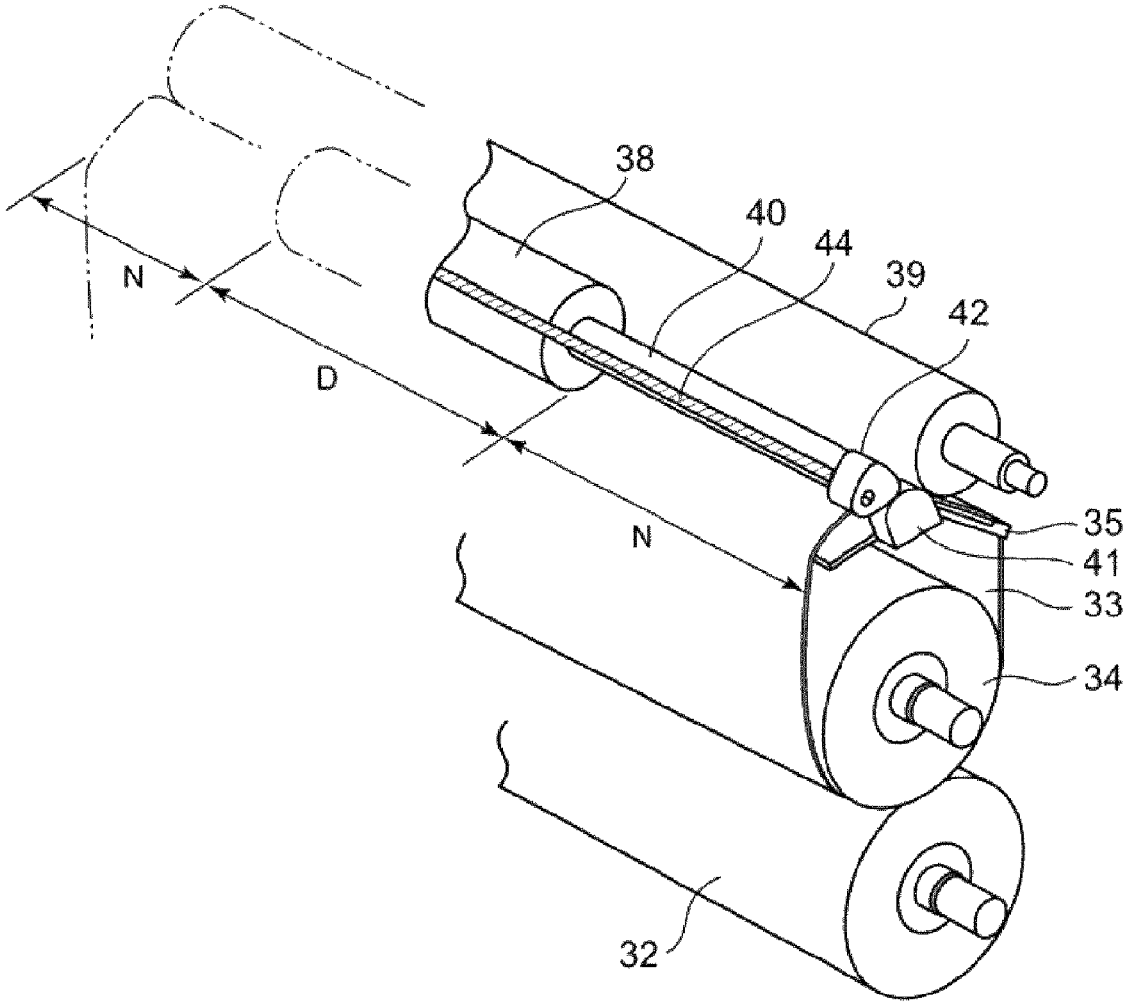
FIG. 6 is a partial perspective view of a fixing belt assembly of the first embodiment.

FIG. 6 illustrates a perspective view of the fixing belt assembly 31 discussed above. A description of the fixing belt assembly 31 is given below with reference to FIGS. 1 and 6. A central pressing roller 38 and an auxiliary roller 39 are further included in the fixing belt assembly 31. The central pressing roller 38 is rotatably attached to a shaft 40, as illustrated in FIG. 6. The shaft 40 is movably supported such that it can move toward and away from the fixing belt 33 by a supporting member (not shown). When the central pressing roller is moved toward the fixing belt 33, the central pressing roller 38 presses against the heat transfer member 35 via the fixing belt 33. That is, the central pressing roller 38 presses the fixing belt 33 against the heat transfer member 35. The width of the central pressing roller 38 is the same as an NWM width, which is the width of a B5 size sheet, a postcard, or the like.

Also, a bearing unit 41 is attached to the end of the shaft 40. The bearing unit 41 contacts an end of a compression spring 43 (see FIG. 1) while contacting a cam 42. The bearing unit 41 is held between the cam 42 and the compression spring 43 and is engaged with and disengaged from the heat transfer member 35 according to rotation of the cam 42. The cam 42 is attached to the end of a shaft 44 illustrated in FIG. 6, the shaft 44 is rotated by a cam driving unit 54, which is described later. When the shaft 44 rotates, the cam 42 rotates; as a result, the bearing unit 41 is moved up and down. The other end of the compression spring 43 is fixed by a holding member 45. Thus, a mechanism for selectively engaging and disengaging the heat transfer member 35 and the fixing belt 33 includes the central pressing roller 38, the bearing unit 41, the cam 42, and the compression spring 43.

The auxiliary roller 39 is arranged so that it presses the heat source 36 through the fixing belt 33. That is, the auxiliary roller 39 selectively presses the fixing belt 33 against the heat source 36. The width of the auxiliary roller 39 is the same as the width of the heat source 36. The auxiliary roller 39 and the central pressing roller 38 are preferably made of a an heat resistant elastic layer with a thickness of 0.5-2 mm made of silicone rubber onto the outer peripheral surface of an iron core. A release layer, which is made of fluororesins (PFA, PTFE, FEP) or the like, may be formed on the periphery of the elastic layer. Also, the heat resistant elastic layer can be made of other elastic materials, such as silicon sponge and fluororubber. In the fixing belt 33, as shown in FIG. 6, an area corresponding to the width of the central pressing roller 38 in the center is an NWM contacting part D, and both side areas of the area are NWM non-contacting parts N.

Figure 7:
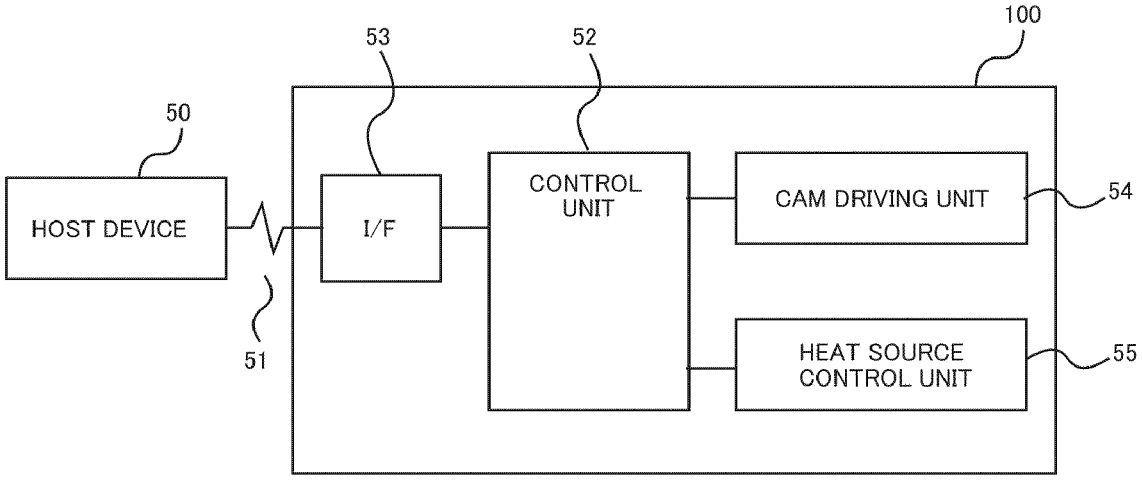
FIG. 7 is a control block diagram of a electrophotographic printer of the first embodiment.

FIG. 7 is a control block diagram of an electrophotographic printer 100 of the first embodiment. Only an element especially related to the present invention is illustrated in FIG. 7, and the other components are omitted. In FIG. 7, the electrophotographic printer 100 is connected to a host device 50 via a network line 51. The host device 50 transmits print information that includes print data and medium size information to the electrophotographic printer 100.

A control unit 52, an interface unit 53, a cam driving unit 54, and a heat source control unit 55 are formed in the electrophotographic printer 100. The control unit 52 controls an entire operation of the electrophotographic printer 100 including conveying control of a medium P, an operation control of an image forming unit, and an operation control of a fixing device 30. The interface unit 53 transmits and receives data between the host device 50 via the network line 51. The cam driving unit 54 rotates the shaft 44 of the cam 42 with a command from the control unit 52. The heat source control unit 55 controls the temperature of a heat source 36.

A description of the operation of the fixing device of the first embodiment follows. Initially, an image forming operation prior to a fixing operation is performed is briefly described. When a print operation is started by a command from the host device 50, a heat source 36 is turned on by a heat source control unit 55, which heats a fixing belt 33 to a temperature at which fixation can be performed. And a medium P is fed from a medium cassette (not shown), and the medium P is fed into a first image forming unit 10K by the carrying roller pair 21 illustrated in FIG. 2 in time with the image forming operation of image forming units 10K, 10Y, 10M, and 10C. After the medium P has received a toner image at each of the image forming units 10K, 10Y, 10M, and 10C, the medium P is sent into a fixing device 30.

Figure 8:
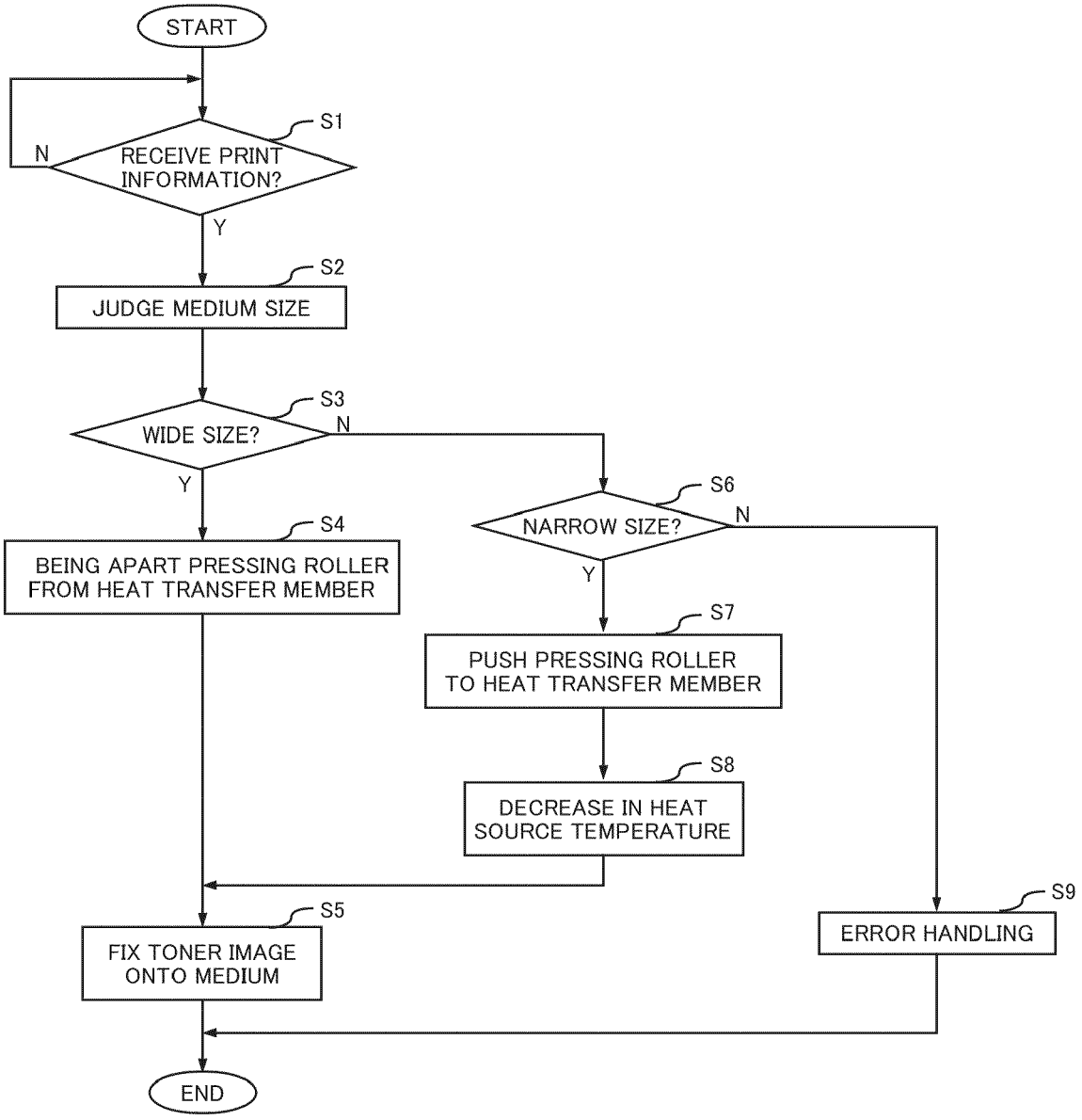
FIG. 8 is a flow diagram of a fixing operation of the fixing device of the first embodiment.

Next, a fixing operation is described in detail according to a flow diagram illustrated in FIG. 8. FIG. 8 illustrates the fixing operation of the first embodiment. Initially, when a control unit 52 receives print information with print data from a host device 50 (S1), the size of the printing medium, which is contained in the print information, is determined (S2). The medium size is judged to be either wide (A4 size, letter size, or the like.) or narrow (B5 size, postcard, or the like.).

When the medium P is judged to be wide (Y in S3), the control unit 52 drives a cam driving unit 54; and the cam driving unit 54 rotates a cam 42 to separate the central pressing roller 38 from the heat transfer member 35 (S4). As for positioning of the cam 42, the shaft 44 may be rotated only by a predetermined degree from a predetermined home position, or the cam 42 may be rotated by a predetermined degree from a detected position, which is determined by a sensor.

When the cam 42 rotates, a bearing unit 41 is separated from the heat transfer member 35 according to the force of a compression spring 43, and the central pressing roller 38 is consequently separated from the heat transfer member 35. Therefore, the fixing belt 33 is separated from a central convex part 35*e* (see FIG. 4) of the heat transfer member 35. At this time, the fixing belt 33 is pressed against the heat source 36 by the auxiliary roller 39, and the fixing belt is heated by the heat source 36.

The fixing belt 33 is driven and slides on the edge 35*d* of the heat transfer member 35 and the heat source 36 by the pressure roller 32, which rotates in the direction of the arrow illustrated in FIG. 1. Electric power is supplied to the heat source 36 from a heat source control unit 55, and the part of the fixing belt 33 that contacts the heat source 36 is heated. As mentioned above, the surface temperature of the fixing belt 33 is maintained in appropriate temperature by the heat source control unit 55 based on the temperature detected by a thermistor (not shown).

The medium P carried to a fixing device 30 is fed into a nipping part 37, which is formed by the pressure roller 32 and a fixing roller 34. The pressure roller 32 and the fixing roller 34 press against one another via the fixing belt 33. When the medium P is sent into the nipping part 37, it is heated and pressed by the fixing belt 33 and the pressure roller 32; and an unfixed toner image 46 on the medium P is fixed to the medium P (S5). After the fixing, the medium P is discharged by a discharge tray (not shown), and the process ends.

When the medium size is judged to be narrow in the S3 (S6), the control unit 52 drives the cam driving unit 54, and it rotates the cam 42 so that the central pressing roller 38 presses the fixing belt 33 against the central convex part 35*e* of the heat transfer member 35 (S7). In this case, too, as for positioning of the cam 42, the shaft 44 may be rotated in only predetermined degree from a home position, or the cam 42 may be rotated in predetermined degree from a position that is detected by a sensor.

Figure 9:
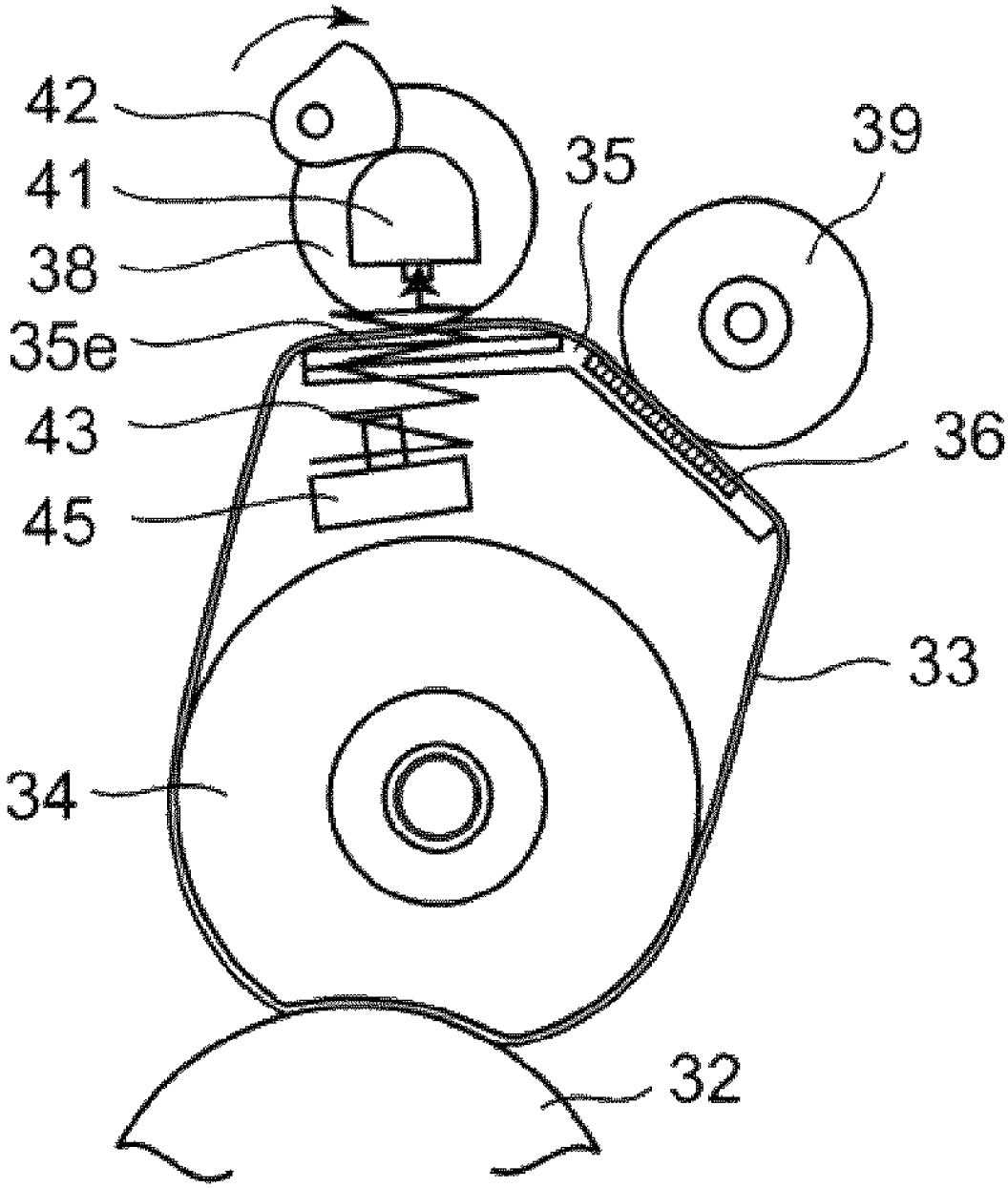
FIG. 9 is a side view of a fixing operation of the fixing device of the first embodiment.
Figure 10:
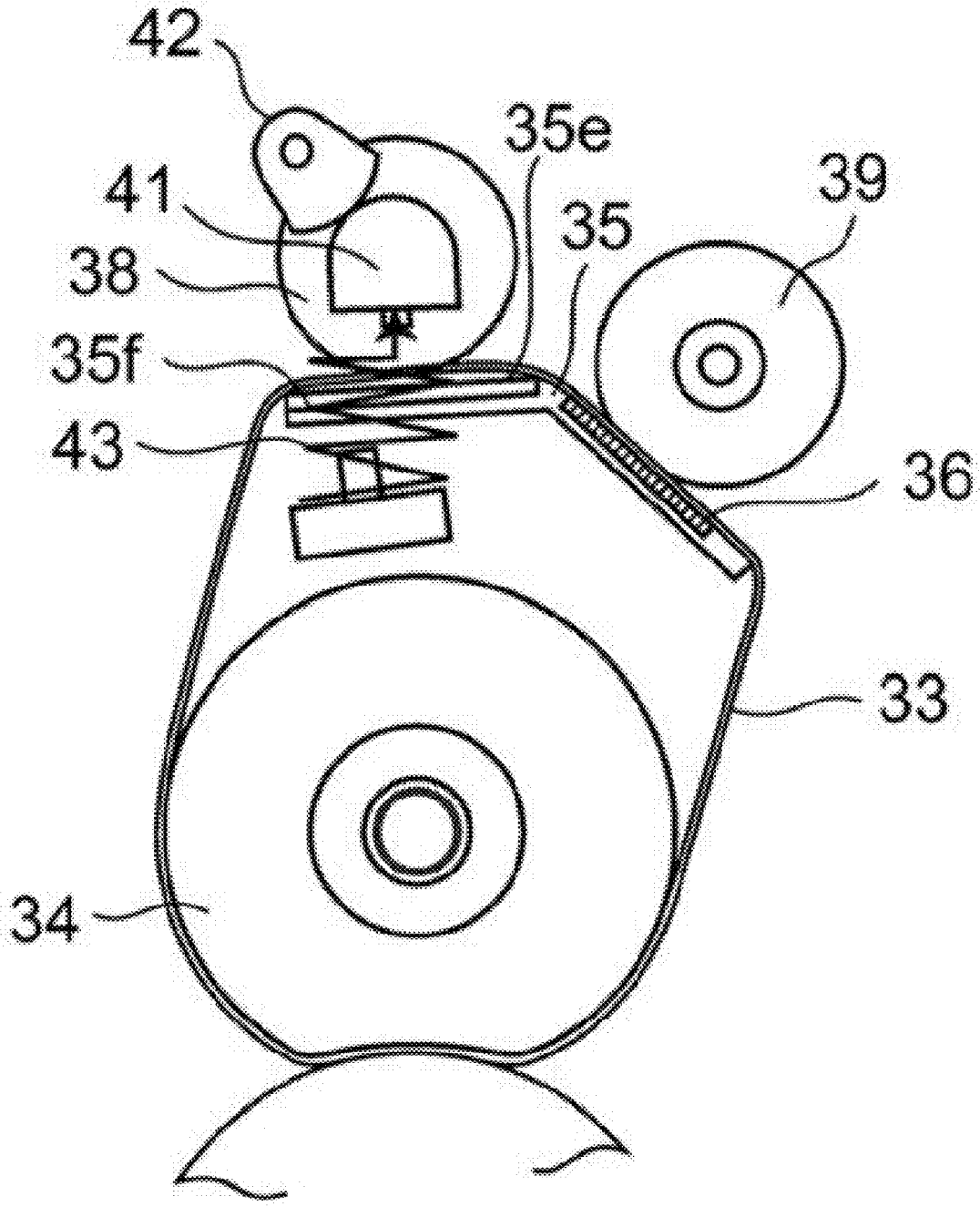
FIG. 10 is a side view of a fixing operation of the fixing device of the first embodiment.

The rotation of the cam 42 in S7 is illustrated in FIGS. 9 and 10. By rotating the cam 42 in clockwise direction from the position illustrated in FIG. 9, the bearing unit 41 is pushed in the direction of the heat transfer member 35 against the force of a compression spring 43, and a central pressing roller 38 presses against the heat transfer member 35 via a fixing belt 33. As a result, the fixing belt 33 presses against a central convex part 35*e* of the heat transfer member 35. This state is illustrated in FIG. 10. As illustrated in FIG. 10, the fixing belt 33 does not contact the concave parts 35*f* on the opposite sides of the central convex part 35*e* at this time.

The center of the fixing belt 33, which contacts the central convex part 35*e* of the heat transfer member 35, is the NWM contacting part D that contacts a narrow-width medium P. The center of the fixing belt 33 is heated by the central convex part 35*e*. Therefore, the NWM contacting part D of the fixing belt 33 is heated by both the heat source 36 and the central convex parts 35*e* of the heat transfer member 35.

Next, the control unit 52 instructs a heat source control unit 55 to lower the temperature of the heat source 36. By doing so, the heat source control unit 55 shortens a time of an "ON" state (heating time) of the heat source 36 (S8). As a result, the quantity of heat that the fixing belt 33 receives from the heat source 36 is decreased. Even if the quantity of heat received from the heat source 36 is decreased, since the NWM contacting part D in the center of the fixing belt 33, which contacts a narrow-width medium P, is heated by the central convex part 35*e* of the heat transfer member 35 as mentioned above, and the NWM contacting part D receives a sufficient quantity of heat for fixing an unfixed toner image 46. On the other hand, as for the NWM non-contacting parts N of the sides of the fixing belt 33, since these parts receive heat only from the heat source 36, the temperature of which has been lowered, the quantity of heat transferred is relatively low; therefore, the temperature of the non-contacting parts N does not rise.

The narrow-width medium P carried to the fixing device 30 is sent into a nipping part 37, and an unfixed toner image 46 on the medium P is fixed to the medium P by heat and pressure from the NWM contacting part D of a fixing belt 33 and a pressure roller 32 (S5). After the fixing of the image, the medium P is discharged to a discharge tray (not shown), and the process ends. When a medium P is not judged to be wide or narrow in step 6, an error results, which is handled by error handling (S9) and the process ends.

As discussed above, in the case of a narrow-width medium P, since the fixing belt 33 is configured to receive heat from the central convex part 35*e* of the heat transfer member 35, the heat that the heat source 36 supplies is decreased, as shown at step 7 (S7) and step 8 (S8), and the quantity of heat that the NWM non-contacting part N of the fixing belt 33 receives is decreased. When fixing a narrow-wide medium P thereafter, as shown at the step 4 (S4), the central pressing roller 38 is separated from the heat transfer member 35, and the fixing belt 33 is heated by the heat source 36. Therefore, the surface temperature of the fixing belt 33 is maintained at an appropriate temperature by the heat source control unit 55, and the difference of fixing temperatures between the center and the sides of the fixing belt 33 is small.

As described above, according to the first embodiment, when an image is fixed on a narrow medium P, the quantity of heat that is transferred to an NWM non-contacting part N of a fixing belt 33 is decreased in the following manner: a central pressing roller 38 is moved by a switching mechanism, an NWM contacting part D of the fixing belt 33 is pressed against a central convex part 35*e* of a heat transfer member 35 and receives heat from the central convex part 35*e* of the heat transfer member 35, and the heat that heat source 36 supplies is decreased. Therefore, even when an image is fixed on a wide medium P after an image is fixed on a narrow medium P, the difference in fixing temperature between the center and the sides of the fixing belt 33 can be made small, and unevenness does not occur in the fixing of the toner image.

Second Embodiment

Figure 11:
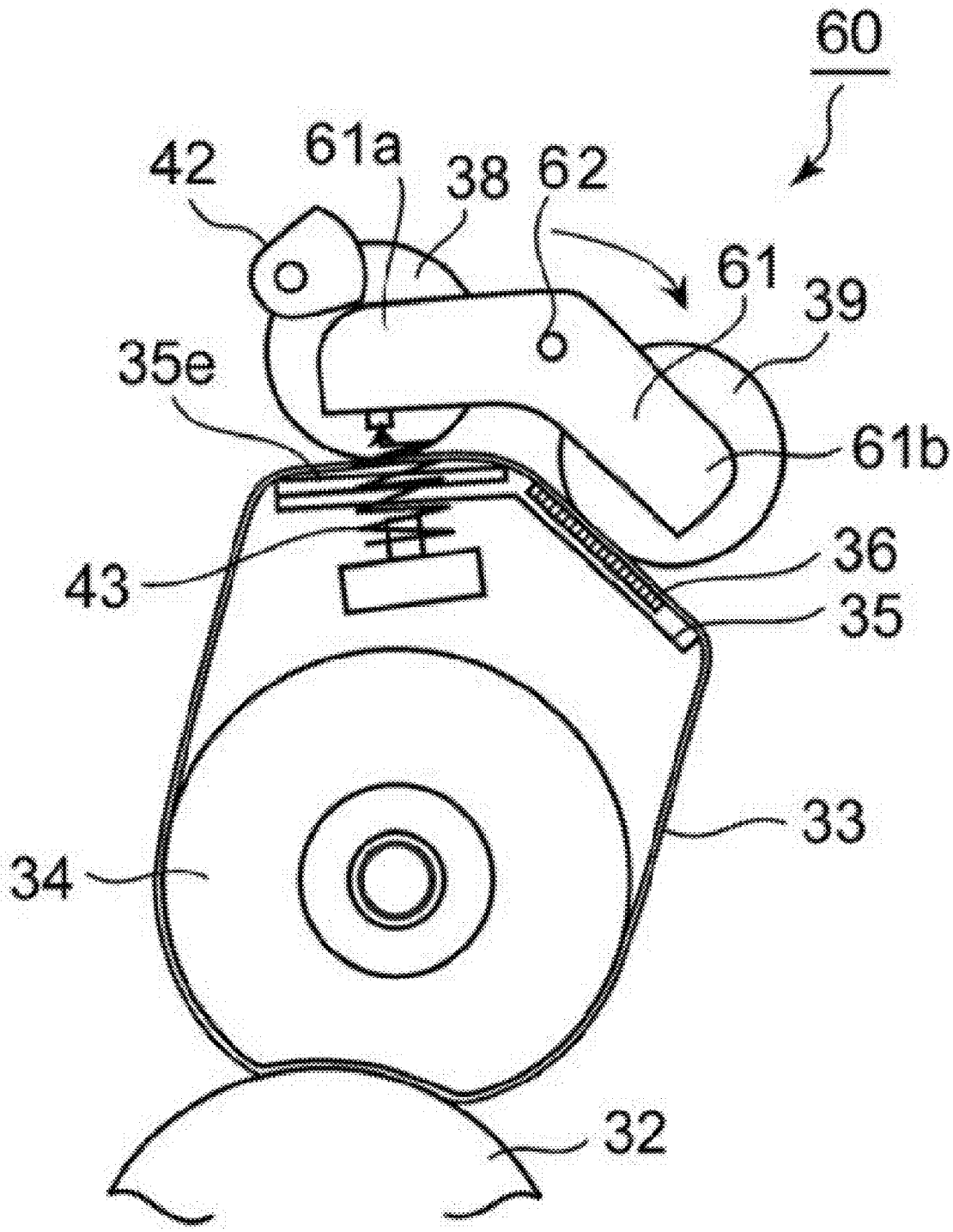
FIG. 11 is a side view of a fixing device of a second embodiment.
Figure 12:
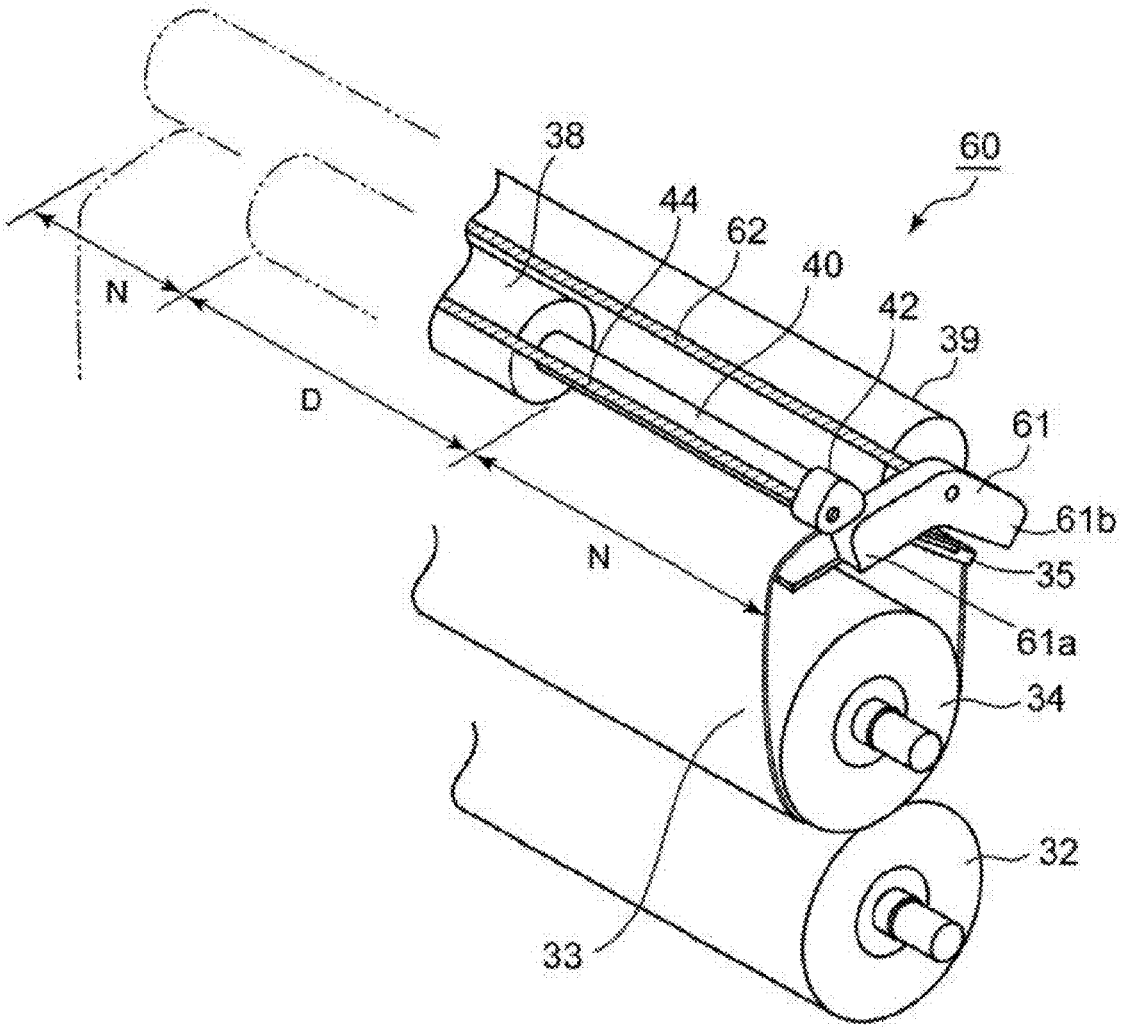
FIG. 12 is a perspective view of the fixing device of the second embodiment.

Next, the second embodiment is described. FIG. 11 illustrates a side view of a fixing device 60 of the second embodiment, and FIG. 12 illustrates a perspective view of the fixing device 60 of the second embodiment. The fixing device 60 of the second embodiment is configured to press an NWM contacting part D of a fixing belt 33 against a heat transfer member 35 and to simultaneously disengage the fixing belt 33 from a heat source 36, when an image is fixed on a narrow-width medium P.

In FIGS. 11 and 12, a pressure roller 32, a fixing belt 33, a fixing roller 34, a heat transfer member 35, a heat source 36, a central pressing roller 38, a cam 42, and a compression spring 43 are arranged in the fixing device 60, in a manner similar to the fixing device 30 of the first embodiment. The shape of the heat transfer member 35 is the same as that of the first embodiment.

An end part 61*a* of a dogleg shaped arm member 61 is attached to an end part of a shaft 40 of the central pressing roller 38. The cam 42 is formed in the approximately upper part of the end part 61*a* of the arm member 61. The arm member 61 is pivotally supported by a shaft 62 illustrated in FIG. 12. The other end 61*b* of the arm member 61 is attached to a shaft of an auxiliary roller 39, and the auxiliary roller 39 is pressed against and separated from the heat source 36 via the fixing belt 33 according to pivotal movement of the arm member 61. In the second embodiment, the engaging and disengaging switching mechanism of the fixing belt 33 and the heat transfer member 35 includes the central pressing roller 38, the cam 42, and the compression spring 43, the auxiliary roller 39 and the arm member 61.

Next, the operation of the second embodiment is described. When a medium P is judged to be wide, cam 42 is set in the position shown in FIG. 11, the end part 61*a* of the arm member 61 is pushed up by a force of a compression spring 43, a central pressing roller 38 is separated from the heat transfer member 35, and the fixing belt 33 is kept from contacting the central convex part 35*e* of the heat transfer member 35. By pushing up the end part 61*a* of the arm member 61, the arm member 61 rotates in a clockwise direction in FIG. 11 about the shaft 62, and the auxiliary roller 39 attached to the other end 61*b* presses against the heat source 36 via the fixing belt 33. As a result, the fixing belt 33 receives heat only from the heat source 36.

Figure 13:
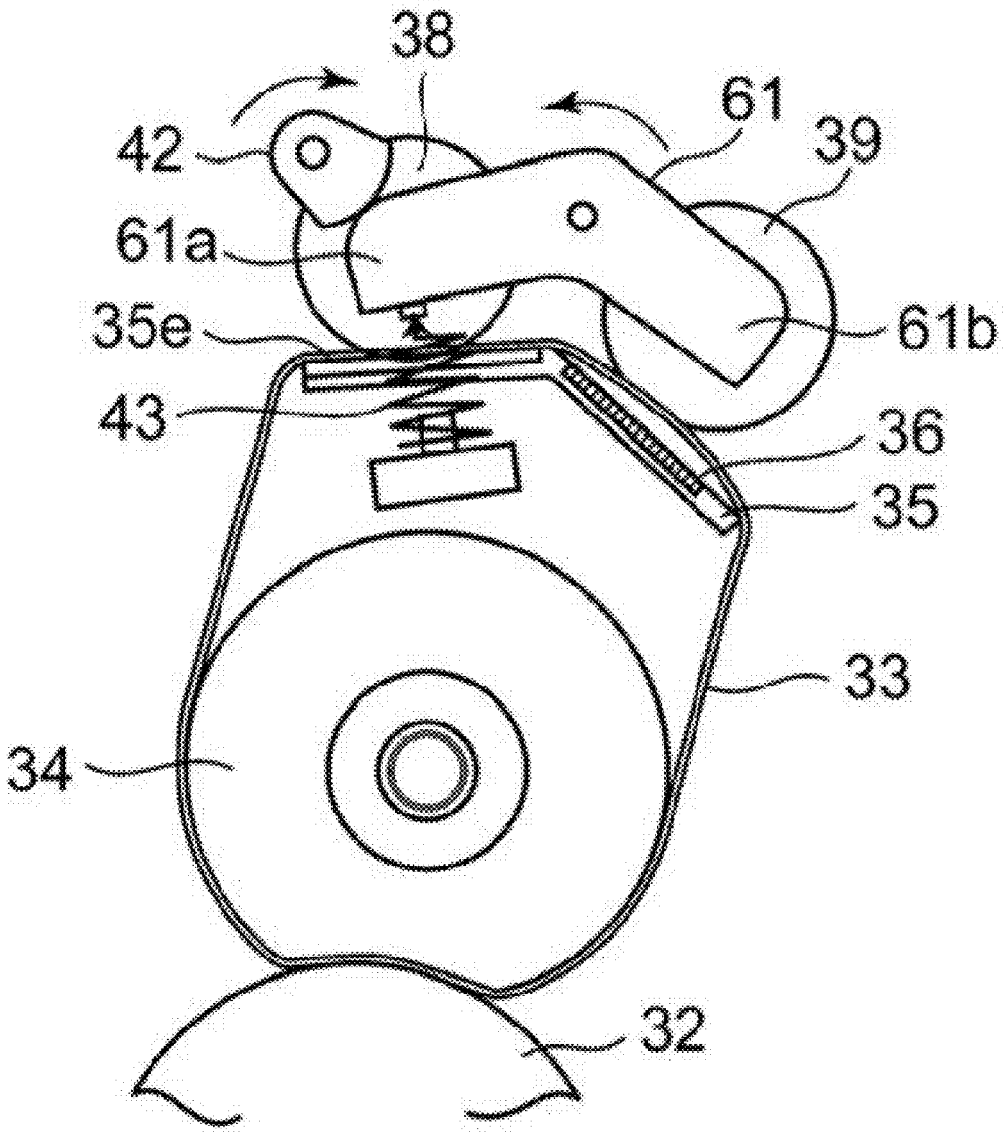
FIG. 13 is a side view of the fixing operation of the second embodiment.

On the other hand, when a medium P is judged to be narrow, the cam 42 is rotated in the clockwise direction in FIG. 11, the end part 61*a* of the arm member 61 is depressed, and as illustrated in FIG. 13, the central pressing roller 38 is pressed against the central convex part 35*e* of the heat transfer member 35. At this time, an NWM contacting part D of the fixing belt 33 contacts the central convex part 35*e*, and an NWM non-contacting parts N of the fixing belt 33 do not contact the heat transfer member 35. By contacting the central convex part 35*e*, the NWM contacting part D of the fixing belt 33 receives heat from the heat transfer member 35.

By depressing the end part 61*a* of the arm member 61, the arm member 61 rotates in the counter clockwise direction in FIG. 13 about the shaft 62, and the other end 61*b* rises; and the auxiliary roller 39 attached to the other end 61*b* is disengaged from the heat source 36. As a result, the fixing belt 33 is separated from the heat source 36, and the fixing belt 33 does not receive heat from the heat source 36. Therefore, heat is transferred only to the NWM contacting part D via the heat transfer member 35.

As discussed above, in the case of a narrow medium P, the fixing belt 33 receives heat only from the central convex part 35*e* of the heat transfer member 35, and heat is not supplied from the heat source 36. When a wide medium P follows, the central pressing roller 38 is separated from the heat transfer member 35, and the fixing belt 33 is heated by the heat source 36. Therefore, the surface temperature of the fixing belt 33 is maintained at an appropriate temperature by the heat source control unit 55, and the difference in the fixing temperature between the center and the sides of the fixing belt 33 is small.

According to the second embodiment as mentioned above, when an NWM P is fixed, since the auxiliary roller 39 is disengaged from the heat source 36 by the arm member 61 to separate the fixing belt 33 from the heat source 36, while pressing the NWM contacting part D of the fixing belt 33 against the central convex part 35*e* of the heat transfer member 35, only the NWM contacting part D of the fixing belt 33 is heated. As a result, even when a wide medium P is fixed after fixing a narrow medium P, the difference in the fixing temperature between the center and the sides of the fixing belt 33 is small, and an unevenness in the fixation of the toner image can be prevented.

Although, in each of the embodiments mentioned above, a sheet heater arranged inside a loop of a fixing belt 33 is used as the heat source 36 for heating the fixing belt 33, a heat source 36 may be formed outside the loop of the fixing belt 33. In this case, a heat transfer member 35 that transfers the heat of the heat source 36 to the fixing belt 33 is movably formed outside of the fixing belt 33, and the heat transfer member 35 is pressed against or disengaged from the fixing belt 33 by a cam according to the medium size. In this case, the heat source 36 is not restricted to a sheet heater.

Figure 14:
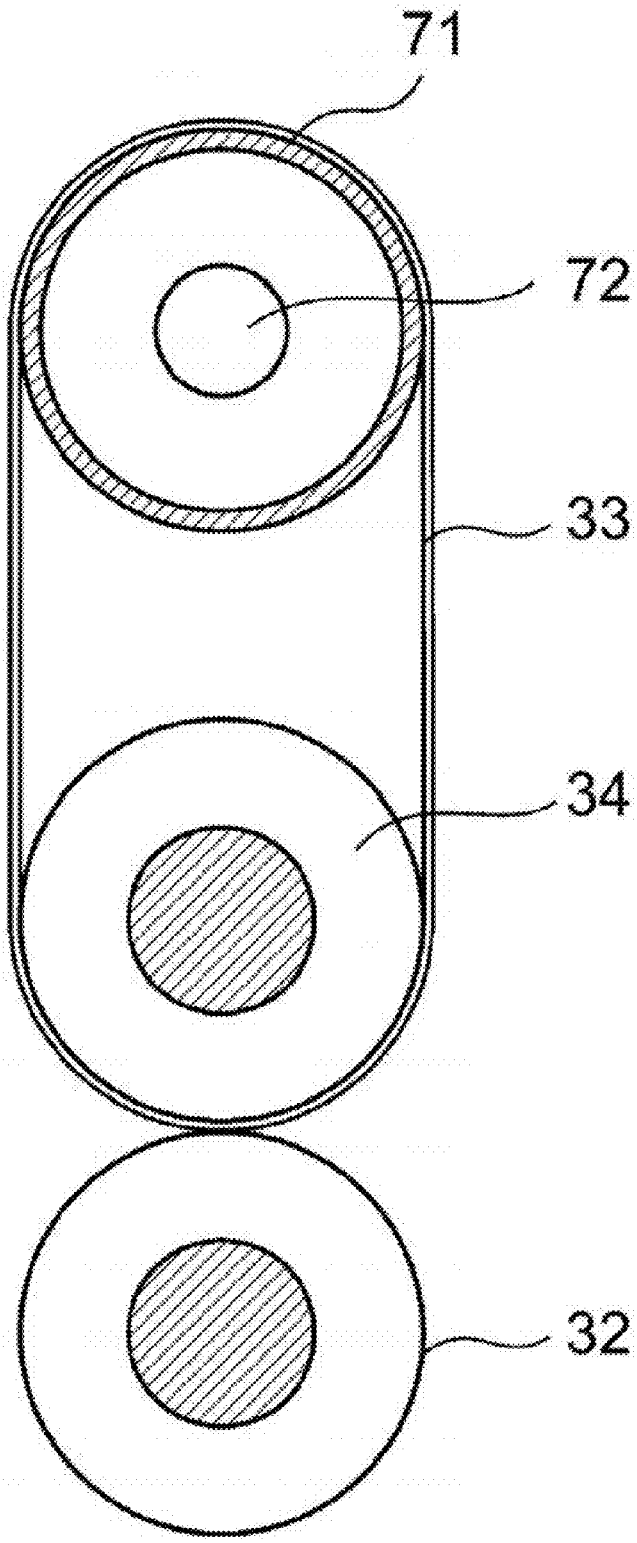
FIG. 14 is a side view of a heat source of a further embodiment.

Further, as a heat source for the first embodiment, it is also possible to set a halogen heater 72 in a metal pipe 71, such as iron, as illustrated in FIG. 14, for example, inside the fixing belt 33. In this case, the heat transfer member (not shown) is movably supported to contact and disengage from the fixing belt 33, and the heat transfer member is pressed against and disengaged from the fixing belt 33 according to the medium size.

Furthermore, in FIGS. 6 and 12 of the description of each of the embodiments mentioned above, although it is described that the width of the central pressing roller 38 is equivalent to the NWM contacting part D, this does not limit the width of the central pressing roller 38. The width of a central convex part 35*e* of the heat transfer member 35 may be correspond to the width of the NWM contacting part D, the fixing belt 33 may just receive heat from the central convex part 35*e* according to the size of the medium, and the width of the central pressing roller 38 may be wider than the central convex part 35*e*.

In the above embodiments, the first and second heaters have different shapes so that the heater is able to heat the fixing belt differently with respect to the lateral direction using one of the two heaters. Namely, the first heater is wider than the second heater so that it heats a wider section in the lateral direction of the fixing belt. However, the present invention is able to be configured to control the heated sections in a longitudinal direction of the fixing belt according to the size of the medium. Specifically, the first heated section is longer in a conveying direction of the belt (the longitudinal direction of the fixing belt) than the second heated section, and the temperature controller adjusts the heating temperatures of the first and second heaters according to which heater is selected. Such an embodiment is realized by controlling the driving conditions of the fixing belt and the heating conditions of the first and second heaters using the control unit 52, the driving unit 54, or the heat source control unit 55, for example. In order to control the driving conditions, the rotation speed of a shaft or cam (for example, the shaft 44 or the cam 42) are useful. In order to control the heating conditions, the timing of when the heater activates or deactivates is useful. Also, it is possible to control the heating temperature. The heating condition is able to be controlled by a controller (for example, the control unit 52 or the heat source control unit 55).

Although each of the embodiments mentioned above is described as, for example, a fixing device of a electrophotographic printer as an image forming device, the present invention can be applied, not just to this device, but to a device that forms an image on a medium by a direct method or an indirect method (transfer) using a toner that includes a resin of heat melting nature, or the like, and that carries out heat and pressure fixing of an unfixed toner image corresponding to a target picture information, with an electrophotographic image forming processes, such as a printer, copying machine or a facsimile machine.

What is claimed is:

1. A fixing device comprising:

an endless fixing belt;

a first heater that heats a first predetermined section of the fixing belt;

a second heater that heats a second predetermined section of the fixing belt;

a switch that determines whether or not the second predetermined section of the fixing belt is heated by the second heater;

a controller controls a switching operation of the switch according to a size of a medium on which an image is fixed by the fixing belt; and a temperature controller that reduces a heating temperature of the first heater when the second predetermined section of the fixing belt is heated by the second heater.

2. The fixing device according to claim 1, wherein the temperature controller reduces the heating temperature of the first heater by shortening a heating time of the first heater, when heating the fixing belt by the second heater.

3. The fixing device according to claim 1, wherein the second heater comprises a heat transfer member to which heat is transferred from the first heater.

4. The fixing device according to claim 3, wherein the switch further comprises:

a movable roller member arranged to move toward and away from the fixing belt to press the fixing belt against the heat transfer member and to separate from the fixing belt; and a cam member that, by rotating, causes the roller member to move toward and away from the heat transfer member.

5. The fixing device according claim 1, wherein the second heater is configured narrower than the first heater in a direction perpendicular to a rolling direction of the fixing belt.

6. An image forming device, comprising, the fixing device according to claim 1 that is equipped as a part of the image forming device.

7. The fixing device according to claim 1, wherein the switch is a mechanism for moving a movable roller member toward and away from the second heater, wherein the roller member causes the fixing belt to engage and separate from the second heater according to a position of the mechanism.

8. The fixing device according to claim 7, wherein the mechanism further includes an auxiliary roller that moves toward and away from the first heater for pressing the fixing belt toward the first heater and for permitting the fixing belt to separate from the first heater, wherein the auxiliary roller is moved away from the first heater when the movable roller member moves toward the second heater.

9. A fixing device comprising:

an endless fixing belt;

a first heater that heats a first predetermined section of the fixing belt;

a second heater that heats a second predetermined section of the fixing belt;

a switch that determines whether the first predetermined section of the fixing belt is heated by the first heater, or the second predetermined section of the fixing belt is heated by the second heater; and a switch controller that actuates the switch according to a size of a medium on which an image is fixed by the fixing belt.

10. The fixing device according to claim 9, wherein the second heater comprises a heat transfer member to which heat is transferred from the first heater.

11. The fixing device according to claim 10, wherein the switch further comprises:

a first roller member arranged to move toward and separate from the first heater to move the fixing belt toward or away from the first heater;

a second roller member arranged to move toward and separate from the heat transfer member to move the fixing belt toward or away from the heat transfer member;

a rotatable arm member that has a first end part and a second end part, wherein the second roller member is attached to the second end part of the rotatable arm member, and wherein the first roller member is attached to the first end part of the rotatable arm member; and a cam member that causes the rotatable arm member to pivot.

12. A fixing device comprising:

an endless fixing belt that rolls in a longitudinal direction;

a first heater that heats a first longitudinal section of the fixing belt;

a second heater that heats a second longitudinal section of the fixing belt:

a switch that determines whether the first longitudinal section of the fixing belt is heated by the first heater, or the second longitudinal section of the fixing belt is heated by the second heater according to a size of a medium on which an image is fixed by the fixing belt;

a temperature controller that adjusts a heating temperature of the first heater when the second heater heats the second longitudinal section of the fixing belt.

13. The fixing device according to claim 12, wherein the second heater comprises a heat transfer member to which heat is transferred from the first heater.

14. The fixing device according to claim 13, wherein the switch further comprises:

a movable roller member arranged to move toward and away from the fixing belt to press the fixing belt against the heat transfer member and to separate from the fixing belt; and a cam member that, by rotating, causes the roller member to move toward and away from the heat transfer member.

15. The fixing device according to claim 12, wherein the second longitudinal section of the fixing belt is narrower than the first predetermined section.

16. An image forming device, comprising, the fixing device according to claim 12 that is equipped as a part of the image forming device.

17. A fixing device comprising:

an endless fixing belt for fixing an image on a medium;

a first heater that heats a first lateral section of the fixing belt;

a second heater that heats a second lateral section of the fixing belt, wherein the second lateral section overlaps the first lateral section and is more narrow than the first lateral section such that the second lateral section is heated by both the first heater and the second heater;

a mechanism that determines whether or not the second lateral section of the fixing belt is heated by the second heater by selectively pressing the fixing belt against the second heater;

a controller that controls the mechanism according to a size of the medium, to supplementally heat a part of the fixing belt that contacts a relatively narrow medium.

18. The fixing device according to claim 17, wherein the second heater comprises a heat transfer member to which heat is transferred from the first heater.

19. The fixing device according to claim 18, wherein the mechanism comprises a movable roller member arranged to move toward and away from the fixing belt to press the fixing belt against the heat transfer member and to separate from the fixing belt.

20. The fixing device according to claim 17, wherein the mechanism is constructed to move a movable roller member toward and away from the second heater, wherein the roller member causes the fixing belt to engage and separate from the second heater according to a position of the mechanism.

* * * * *